US005446678A

United States Patent [19]

Saltzstein et al.

[11] Patent Number: 5,446,678

[45] Date of Patent: Aug. 29, 1995

[54] TRANSMISSION OF INFORMATION OVER AN ALPHANUMERIC PAGING NETWORK

[75] Inventors: William E. Saltzstein, Amity; Ray Wardell, McMinnville, both of Oreg.

[73] Assignee: Hewlett-Packard Corporation, Palo Alto, Calif.

[21] Appl. No.: 993,473

[22] Filed: Dec. 18, 1992

[51] Int. Cl.[6] ..... G08B 5/22

[52] U.S. Cl. ..... 364/514 R

[58] Field of Search ..... 364/514; 340/825.44, 340/311.1; 379/56, 170, 217; 178/25, 26.1; 116/234

[56] References Cited

U.S. PATENT DOCUMENTS 4,429,385 1/1984 Cichelli et al. ..... 340/825.44
4,783,654 11/1988 Ichikawa ..... 340/825.44
4,967,194 10/1990 Haruki ..... 340/825.44
5,023,905 6/1991 Wells et al. ..... 340/825.44
5,043,721 8/1991 May ..... 340/825.44
5,109,220 4/1992 Breeden et al. ..... 379/56
5,146,216 9/1992 Deluca et al. ..... 340/825.44
5,166,932 11/1992 Hoff et al. ..... 340/825.44

*Primary Examiner*—Ellis B. Ramirez
*Attorney, Agent, or Firm*—Curtis G. Rose; Brent F. Logan

[57] ABSTRACT

A method of sending acquired graphical data over an alphanumeric paging service. The data is compressed, split into and blocks of a size which the paging service can handle, and transferred to the paging service. The paging service transmits the data to a wireless receiver attached to a computer. The computer displays the information on its display, and can further process the data.

16 Claims, 3 Drawing Sheets

TRANSMISSION OF INFORMATION OVER AN ALPHANUMERIC PAGING NETWORK

TECHNICAL FIELD

The present invention relates to sending information over a wireless network to a remote receiver. More specifically, it relates to the transmission over an alphanumeric paging network of binary information to be graphed.

BACKGROUND ART

It is frequently necessary to alert someone to a changing condition and provide graphical information for interpretation. For example, a hospital often needs to alert a doctor to a patient's changing condition and provide the doctor with the patient's electrocardiogram for diagnosis. Or, more generally, in a process control situation, such as a power generation plant or a manufacturing line, it can be beneficial to update an expert on the current conditions and the recent history. Many times, the expert may not be present on the site and thus must be contacted by a method not dependent on his location.

Facsimile transmission is one method of sending graphical information. The availability of cellular telephones, portable facsimiles, and batteries permit facsimile reception in the field. However, scanning for facsimile transmission can introduce noise and errors into the information. Even when a computer sends information using a "fax modem," thereby eliminating the printing and scanning steps, the facsimile process necessarily alters the scale and limits the resolution of the transmitted information. Furthermore, the combination of a facsimile receiver, cellular telephone, and the required batteries to power them would be so great that it would not be carried at all times.

Existing paging networks, paging receivers, and palmtop computers permit alphanumeric information to be conveniently received over broad areas. The small size of a Hewlett-Packard 95LX palmtop computer and an associated paging receiver allow the combination to be carried virtually everywhere.

Paging networks were not designed to transmit large block of binary data. Thus, they typically transmit only a limited 7-bit character set, thereby prohibiting the transmission of an unmodified graphical binary data file. Furthermore, a paging network may strictly limit message size to less than that of the typical graphical file.

DISCLOSURE OF THE INVENTION

A primary object of the present invention is to provide a means for sending graphical information over an alphanumeric paging network.

Another object of the present invention is to provide a means for transmitting information which allows the recipient to reconstruct acquired data for graphing at a remote location.

Another object of the present invention is to provide a means for transmitting information which allows the recipient to reconstruct acquired data for further processing at a remote location.

Another object of the present invention is to provide a means for sending graphical information over an alphanumeric paging network having message length limitations which prevents the graphical information from being sent in a single message.

A further object of the present invention is to provide a means for sending graphical information over an alphanumeric paging network having a character set limitation which prevent the transmission of an unmodified binary graphical data file.

As a feature of the present invention, graphical information is compressed, converted to a 7-bit data stream, split into messages of a size which the paging network can handle, and then transferred to the network. The network transmits the messages to a paging receiver which provides the messages to a palmtop computer. The palmtop computer reassembles the messages in their proper order, re-converts and decompresses the data for display and possible further analysis and processing.

BRIEF DESCRIPTION OF THE DRAWINGS

The above and other objects, features and advantages of the present invention will become more apparent from the following detailed description along with the accompanying drawings in which.

BEST MODE FOR CARRYING OUT THE INVENTION

Figure 1:
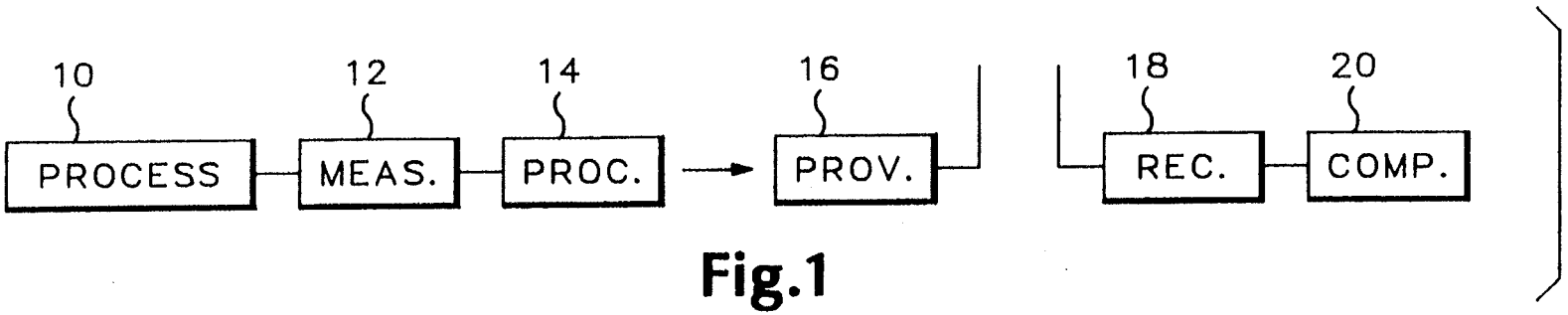
FIG. 1 is a general block diagram of a system for carrying out the invention.
Figure 3:
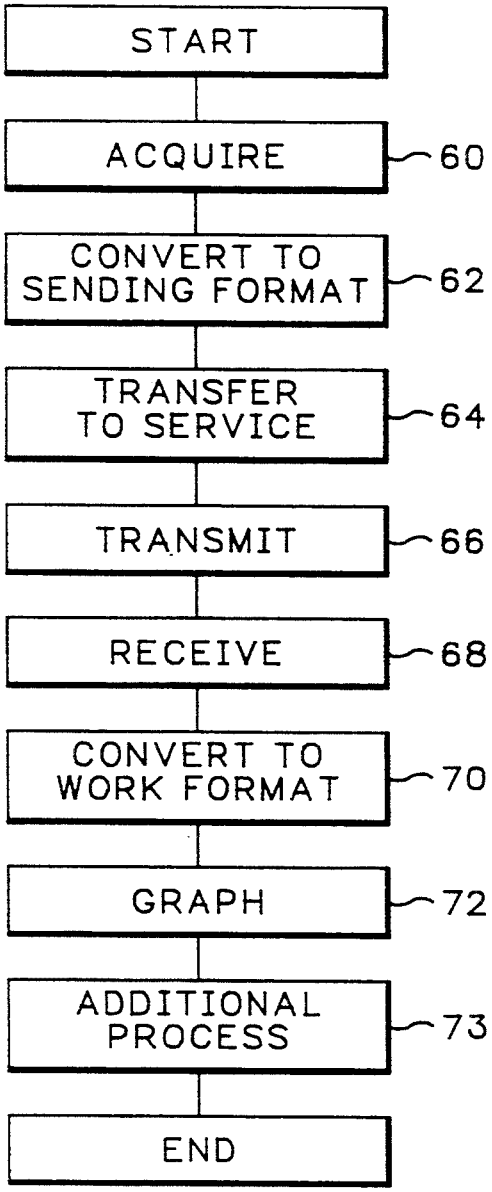
FIG. 3 is a flow chart of the steps performed by the system of FIG. 2.

An overview of a system and method for carrying out the present invention is seen in FIGS. 1 and 3. As a first step, a measurement device 12 measures a process 10, thereby acquiring 60 data. Typically, the acquired data is most conveniently analyzed in graphical form. After the data is acquired, a digital processor 14 converts 62 it a format acceptable to a paging provider 16. This conversion step may include selecting which graphical data is to be transmitted and combining it with associated alphanumeric information, thereby forming a "data stream." To perform the conversion, the data stream may be compressed, converted to a limited character set, and then split into message blocks no larger than the paging provider can handle. The converted data stream is transferred 64 to the paging provider.

The paging provider 16 transmits 66 the message blocks to a wireless receiver 18, which receives 68 them and provides them to a palmtop computer 20. The computer converts 70 the message blocks back to a usable format, reversing the original conversion process 62. The computer then graphs 72 the information for viewing. Additionally, because the computer has the raw data as acquired, it may perform 73 additional processes on it. These steps will be discussed in more detail below with respect to a system for sending electrocardiograms.

Figure 2:
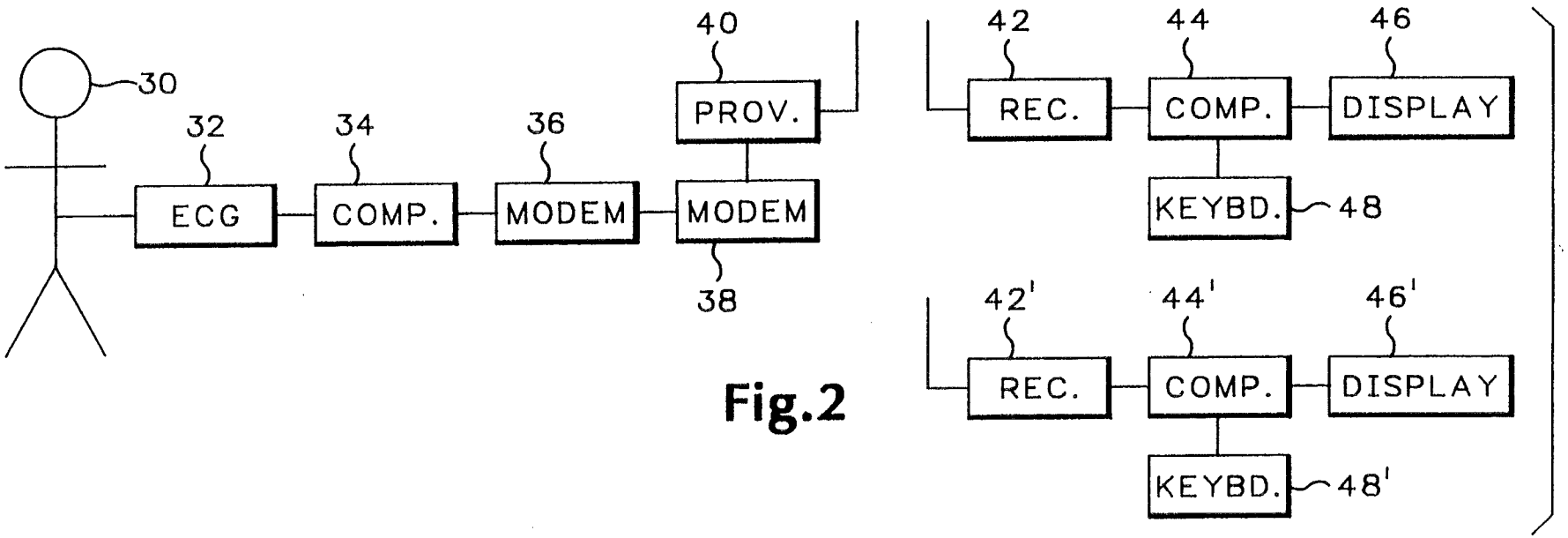
FIG. 2 is a schematic block diagram of a system for sending electrocardiograms according to the present invention.

Referring now to FIG. 2, an exemplary system for sending electrocardiograms includes an electrocardiograph 32 to acquire the electrocardiogram from a patient 30. A computer 34 can perform the conversion step 62 and transfer the resulting messages to the paging provider 40 via modems 36, 38. The paging provider 38 transmits the messages to a receiver 42 associated with a palmtop computer 44. The doctor may then instruct the computer to display the electrocardiograph on its display 46 or to perform further processing using the keyboard 48.

In some cases, it may be beneficial to send the information to more than one doctor or expert. In such cases, the second doctor could also carry a computer 44' having a display 46' and keyboard 48' and being connected to a paging receiver 42'. If both doctors always would receive the same messages, their respective paging receivers 42, 42' could both be programmed with the same identification code. This way, both receivers would receive the same messages. Alternatively, if the doctors' receivers 42, 42' are programmed with differed codes, the paging provider 40 could be instructed to send the information twice, once for each paging receiver identification code.

Some electrocardiographs 32 are designed much like a general purpose computer in that they are programmable and have industry standard interfaces to communicate with standard computer peripherals. Such electrocardiographs may be programmed to perform the necessary conversion step 62, thus performing the function of the processor 34. Furthermore, such an electrocardiograph 32 could transfer the messages to the provider over telephone lines using an attached modem 36. The provider also would have a modem 38 to receive the messages.

Other electrocardiographs are not reprogrammable, or do not have the necessary programming to perform the required conversion step 62, but have the ability to write acquired data to floppy disks in a standard format. In such cases, a separate general purpose computer would read the data from the floppy disk and serve as the processor 34.

Figure 4:
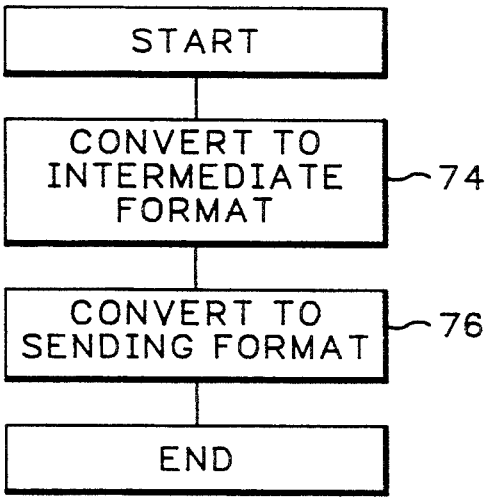
FIGS. 4, 5, and 6 are detailed flow charts of portions of the flow chart of FIG. 3.

Referring now to FIG. 4, when a separate computer converts the data to the sending format, preferably the computer can receive, process, and transfer data from different electrocardiographs. In such cases, the conversion step may be composed of two separate steps: the electrocardiograph converting 74 the data to an intermediate format and saving it to disk, and the computer reading the information from the disk and converting 76 it to the sending format. The intermediate format preferably would be one which could be written by electrocardiographs from different manufacturers and would contain a superset of the information likely to be sent, allowing the conversion step to include selecting the data to be sent. Alternatively, the separate computer could have the ability to read multiple intermediate formats.

An intermediate format preferably includes 2.5 seconds of standard 12-lead ECG. Optionally, the ECG could provide a pointer to the start of a representative beat within the standard ECG. It may also include a rhythm strip of one to three selected leads for ten seconds each. This waveform data is in digital form, having been sampled at (or converted to) 250 samples per second. Its resolution preferably is 16 bits per sample with each sample's least significant bit representing 10 microVolts.

The intermediate format also includes alphanumeric information on patient and test information. Patient information includes the patient's name, age, sex, height, weight, systolic and diastolic blood pressure, race, and medication and diagnosis codes. Test information includes the operator's name, the department, who required the ECG, the patient's room number, and whether the ECG was requested "stat."

Finally, the intermediate format includes comments and any machine measurements and interpretations. Refer to Table 1 for a concise listing of the preferred information contained in the intermediate format.

TABLE 1

| Item | Description |
|---|---|
| 1 | 2.5 Second 12-Lead ECG |
| 2 | Representative Beats |
| 3 | 10 Second Rhythm Strip A |
| 4 | 110 Second Rhythm Strip B |
| 5 | 10 Second Rhythm Strip C |
| 6 | Patient Name |
| 7 | Patient Age |
| 8 | Patient Sex |
| 9 | patient Height |
| 10 | Patient Weight |
| 11 | Patient Systolic Blood Pressure |
| 12 | Patient Diastolic Blood Pressure |
| 13 | Medication Codes |
| 14 | diagnosis Codes |
| 15 | Test Operator's Name |
| 16 | Department |
| 17 | Requester's Name |
| 18 | Patient Room Number |
| 19 | STAT Code |
| 20 | Comment Field |
| 21 | Machine Measurements |
| 22 | Machine Interpretations |

The acquired data is converted to a sending format before it is transferred 64 to the paging provider 40. A paging provider typically has limits on the type of information it can transmit. The message must be no longer than a set length, and is typically limited to a subset of the ASCII character set. As such, it may be limited to seven bits per character. The conversion step 62 processes the data to minimize its size and break it into separate messages which may be reassembled by the receiver 42.

Figure 5:
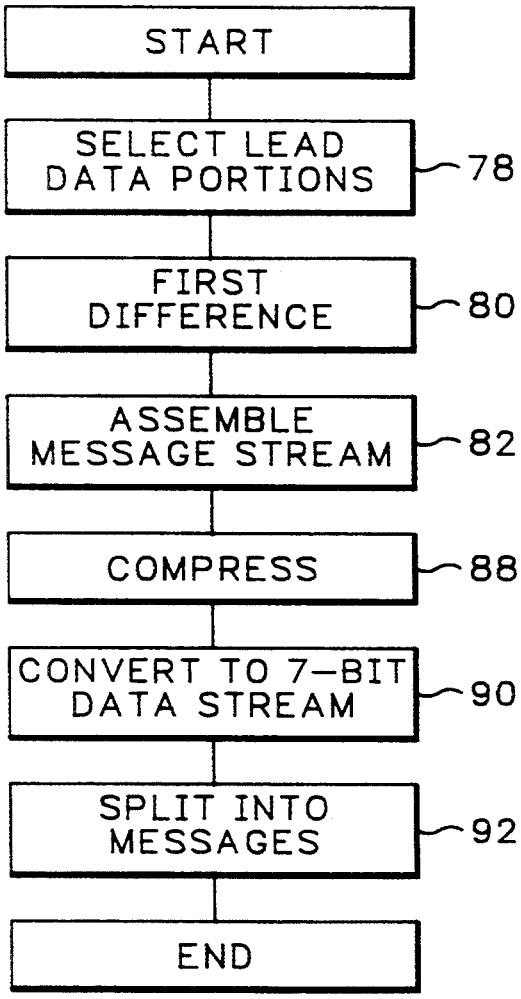

Referring now to FIG. 5, as a first step of converting to the sending format, the portions of the lead data to be sent are selected 78. This step may be done by the electrocardiograph for the similar purpose of selecting which beat to display on its report, or may be done by the computer or electrocardiograph for the specific purpose of transmitting the ECG over the paging network. If the electrocardiograph provides the information, it is in the representative beat information of the intermediate file format. Although all of the information in the intermediate file format may be sent, any selection process which pares the information to be sent also decreases transmission time and cost.

Next a first difference 80 is performed on the lead data. This is accomplished by successively subtracting a data point from the next point. Each data point has 16 bits resolution, but the difference may be stored in 8 bits. The resulting sequence of differences includes all the information in the original sequence except the starting DC value, which is stored as the first 16 bits of the sequence. This first difference process effectively halves the size of waveform data to be sent, and is also performed on the rhythm strips, if any.

Next the message stream is assembled 82. The message stream may include all of the information in the intermediate format. However, some information may be omitted such as rhythm strips, comments, and machine interpretive information. Thus, the message stream includes a "table of contents" to assist the receiving computer in interpreting and processing the received information. The table of contents lists each item included in the message stream. Following the table of contents is the alphanumeric data, the lead data, and any rhythm strips.

Next, the assembled message stream may be compressed 88. There are a number of good compression techniques available, many being listed in introductory computer programming texts. Different types of data can be compressed more efficiently using different algorithms. The process of taking the lead data's first difference 80 also has the effect of compressing the data.

Depending on the paging provider's limitations, the compressed message stream is then converted 90 to a seven-bit data stream. As with compression, many techniques for accomplishing this are known. One such technique is performed by the "uuencode" command of the "UNIX" operating system. If the paging provider 16 (FIG. 1) can transmit all of the seven-bit characters, this conversion step merely consists of treating the eight-bit data stream as a stream of bits, and then dividing this stream at seven-bit boundaries. If the paging provider can send only a limited subset of the seven-bit characters, for example transmitting only the characters corresponding to alphanumeric characters and not the ASCII control characters, another conversion process must be used. An inefficient conversion process for such a situation would be to split each eight-bit character of the data stream in half. Each half would be one of sixteen possible four-bit numbers, which could be mapped into the paging provider's permissible subset of seven-bit characters. This is clearly an inefficient conversion. Ideally, the compression 88 and conversion 90 steps occur at the same time, with the compression step mapping the data stream into allowable seven-bit characters. However, as both functions must be performed, the flow diagram of FIG. 5 shows the steps as separate blocks.

The resulting seven-bit data stream is then split 92 into message blocks to be sent by the paging network. The size of the message blocks must be less than the maximum message size the paging provider can transmit. Because the paging network does not guarantee that pages are transmitted in the order received, the messages must include headers which identify the messages' order in the seven-bit data stream. Preferably, each message also would include the number of messages to be sent. Thus, the third message of a seven message data stream could include a code meaning "third of seven" in its header. This allows the receiver to be determine whether it received all the messages if it receives at least one message. A "checksum" could be performed on each message and its result included in the header. Finally, the header should include a code at its beginning instructing the receiver to interpret it as a message to be reassembled into a message stream. This allows the paging receiver to be used to receive typical alphanumeric pages as well as the pages contemplated by this invention.

Referring again to FIG. 3, the individual message blocks are then transferred 64 to the paging network. As part of this transfer, the paging network is informed of the intended recipient, or recipients, of the messages.

The paging provider transmits 66 the individual messages to a receiver which receives and stores the messages. Once all the messages are received, the palmtop computer reassembles 70 the original data by reversing the conversion process just described. If an error has occurred and one or more messages have not been received, or if the checksum shows that a message was corrupted in transmission, the computer can alert the doctor.

Figure 6:
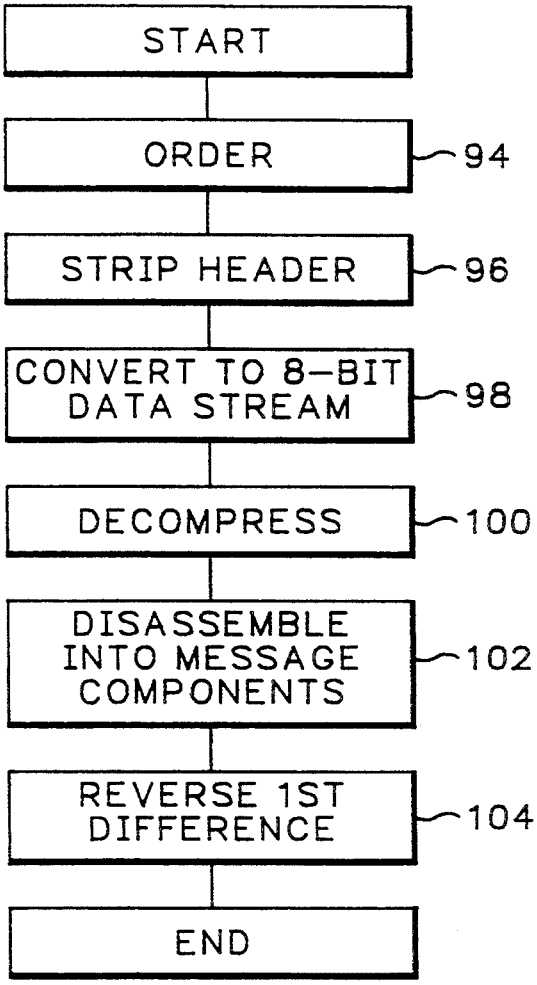

Referring now to FIG. 6, the palmtop computer places the messages into their appropriate order 94 given in their headers, and then strips 96 the message headers from the data. the data is converted 98 back to an eight-bit data stream using the appropriate process to reverse the effects of block 90 (FIG. 5). The resulting data stream is decompressed 100 and disassembled 102 into its component parts. The lead data may be reconstructed 104 from the first difference data, or may be used in that form.

At this point, the palmtop computer has the acquired electrocardiograph data in digital form for graphing and further processing. Preferably, the computer could display a single lead on the display, allowing the waveform to be enlarged, and measuring markers to be placed. This would allow the doctor to measure time periods and voltages more accurately than if the ECG had been sent by facsimile transmission.

The computer should also be able to display concurrently two selected leads having the same time scale, enabling the doctor to compare them.

The alphanumeric patient and test information may be displayed, along with any machine interpretation information.

As an added advantage of having the ECG in digital form, the palmtop computer could run a measuring routine or an interpretive routine locally.

The present invention has been described in connection with acquired waveform data to be graphed. The invention may also be used to transmit data already in a graphical form, such as binary image, or bit mapped files. Such files may be acquired by medical imaging systems, plant security cameras, or any other process which results in an image file.

What is claimed is:

1. A method of transmitting information, comprising the steps of:

sampling a set of data, thereby acquiring digital data;

converting said digital data to a format acceptable to a paging network, thereby creating a binary data stream in a non-graphical form;

transmitting said binary data stream over said paging network;

receiving said binary data stream;

unconverting said binary data stream, thereby creating said digital data; and processing said digital data.

2. The method of claim 1, wherein said processing step further comprises the steps of:

generating a graphical image from said digital data; and displaying said graphical image.

3. The method of claim 1, wherein said processing step further comprises the step of:

running a routine interpreting said digital data.

4. The method of claim 1, wherein said converting step further comprises the step of:

compressing said digital data to create compressed digital data prior to creating said binary data stream.

5. The method of claim 4, wherein said unconverting step further comprises the step of:

uncompressing said compressed digital data prior to creating said digital data.

6. The method of claim 5, wherein said compressing step further comprises the step of:

performing a first difference on said digital data by successively subtracting a data point in said digital data from the next data point in said digital data.

7. An apparatus for transmitting information, comprising:

means for sampling a set of data, thereby acquiring digital data;

a first processor for converting said digital data to a format acceptable to a paging network, thereby creating a binary data stream;

a paging provider for transmitting said binary data stream over said paging network;

a pager for receiving said binary data stream;

a second processor for unconverting said binary data stream, thereby creating said digital data; and said second processor also for processing said digital data.

8. The apparatus of claim 7, wherein said second processor further comprises means for generating a graphical image from said digital data, said paging network further comprising:

a display for displaying said graphical image.

9. The apparatus of claim 8, wherein said second processor further comprises:

means for running a routine interpreting said digital data.

10. The apparatus of claim 7, wherein said converting means further comprises:

means for compressing said digital data to create compressed digital data prior to creating said binary data stream.

11. The apparatus of claim 10, wherein said unconverting means further comprises:

means for uncompressing said compressed digital data prior to creating said digital data.

12. The apparatus of claim 11, wherein said compressing means further comprises:

means for performing a first difference on said digital data by successively subtracting a data point in said digital data from the next data point in said digital data.

13. The apparatus of claim 7, further comprising:

an electrocardiograph for acquiring an electrocardiogram from a patient, said electrocardiogram being said set of data.

14. The apparatus of claim 8, further comprising:

an electrocardiograph for acquiring an electrocardiogram from a patient, said electrocardiogram being said set of data;

wherein said graphical image is a waveform of said electrocardiogram.

15. The apparatus of claim 9, further comprising:

an electrocardiograph for acquiring an electrocardiogram from a patient, said electrocardiogram being said set of data;

wherein said routine interpreting said digital data analyzes said electrocardiogram.

16. The apparatus of claim 13, wherein said first processor is in said electrocardiograph.

* * * * *